United States Patent [19]

Roznieckí

[11] Patent Number: 4,889,189

[45] Date of Patent: Dec. 26, 1989

[54] FIRE SUPPRESSANT MECHANISM AND METHOD FOR SIZING SAME

[76] Inventor: Edward J. Roznieckí, 31041 Angeline, St. Clair Shores, Macomb County, Mich. 48082

[21] Appl. No.: 194,697

[22] Filed: May 16, 1988

Related U.S. Application Data

[62] Division of Ser. No. 546,267, Oct. 28, 1983, abandoned.

[51] Int. Cl.[4] ..... A62C 13/26; A62C 35/02

[52] U.S. Cl. ..... 169/73; 169/72; 169/85; 169/26; 222/386.5

[58] Field of Search ..... 169/72, 73, 85, 26, 169/9, 62, 56–58, 66, 33, 21, 22; 222/386.5, 389, 148; 137/206, 209

[56] References Cited

U.S. PATENT DOCUMENTS

| | | | |
|---|---|---|---|
| 637,250 | 11/1899 | Hall | 137/206 |
| 1,338,778 | 5/1920 | Jones | 169/73 X |
| 1,825,922 | 10/1931 | Roessner et al. | 169/33 X |
| 2,253,601 | 8/1941 | Armstrong | 169/73 |
| 2,557,957 | 6/1951 | Ferguson | 169/73 |
| 2,579,100 | 12/1951 | Smith | 169/73 |
| 2,804,929 | 9/1957 | Plummer | 169/9 |
| 2,808,114 | 10/1957 | Parker, Jr. et al. | 169/62 X |
| 3,211,348 | 10/1965 | Greer | 222/386.5 |
| 3,319,420 | 5/1967 | Mercier | 222/386.5 X |
| 3,327,906 | 6/1967 | Gömann | 222/389 |
| 3,401,750 | 9/1968 | Larsen | 169/73 X |
| 3,408,731 | 11/1968 | Mercier | 222/386.5 X |
| 3,915,237 | 10/1975 | Roznieckí | 169/62 |

FOREIGN PATENT DOCUMENTS

| | | | |
|---|---|---|---|
| 3006519 | 8/1981 | Fed. Rep. of Germany | 169/85 |
| 2173 | of 1913 | United Kingdom | 169/73 |

*Primary Examiner*—Joseph F. Peters, Jr.
*Assistant Examiner*—James M. Kannofsky
*Attorney, Agent, or Firm*—Peter A. Taucher; David Kuhn

[57] ABSTRACT

Disclosed is a fire extinguisher comprising a container separated into two compartments, one compartment containing pressurized gas and the other containing an extinguishant. The container has a valve to release the extinguishant, which is forced from the container when the bladder is expanded by the pressurized gas. The center of the bladder has a force absorbtion means for protection against the impact of the bladder striking the inner wall of the container. The force absorbtion means has two disks clamped together to retain an annular bead of the bladder.

17 Claims, 8 Drawing Sheets

FIRE SUPPRESSANT MECHANISM AND METHOD FOR SIZING SAME

GOVERNMENT INTEREST

The invention described herein may be manufactured, used, and licensed by or for the Government for governmental purposes without payment to me of any royalty thereon.

This is a division of application Ser. No. 546,267, filed Oct. 28, 1983, now abandoned.

SUMMARY OF THE INVENTION

This invention relates to fire suppressant systems using pressurized Halon 1301 extinguishant or other liquid fire extinguishant having the ability to extinguish slow growth fires or explosive type fires, e.g., fires generated in military vehicles due to penetration of the vehicle fuel tank(s) by enemy projectiles.

The invention concerns the mechanical design of a fire suppressant bottle mechanism (including a unique bladder structure), and also a method of sizing the bottle contents; i.e., selecting an optimum quantity of liquid fire suppressant, and the most appropriate pressure for the pressurizing agent.

With regard to the mechanical bottle design, the principal objects of the invention are to provide a bottle-type fire extinguisher mechanism wherein:

1. the bottle is orientable in any convenient attitude, e.g., horizontal, inverted, upright, etc.

2. the liquid extinguishant discharge time is relatively short, e.g., less than 95 milliseconds for a seven pound bottle at 70° F.

3. the bottle mechanism includes a unique internal bladder for physically isolating the liquid fire extinguishant from the gaseous pressurizing agent.

4. the internal bladder is constructed to withstand a very fast stroke without destruction of the bladder or associated mechanisms.

5. after liquid fire extinguishant has been discharged from the bottle new liquid extinguishant can be pumped into the bottle without adding new gaseous pressurizing agent, i.e., the original pressurizing agent can be reused.

6. the bottle mechanism (with internal bladder) operates without dynamic seals.

7. the mechanism operates satisfactorily at relatively high internal pressures over a wide range of ambient temperature conditions.

8. the mechanism is designed to take into account compressibility characteristics of the liquid fire extinguishant.

9. the mechanism can include discharge piping for transporting liquid fire extinguishant from the bottle to remote area(s) requiring fire protection, the bottle including an automatic flush valve operable to permit the pressurizing agent to exert a driving force on liquid fire extinguishant while it is flowing through the discharge piping.

With regard to the method of sizing the bottle contents, my invention has for its principal objects a method wherein:

1. the relative quantities of liquid fire suppressant and pressurizing agent are predetermined so that a satisfactory driving force is maintained on the liquid during the entire liquid discharge time period (regardless of the temperature at which the discharge process takes place).

2. the standby pressure of the system is maintained within a satisfactory range even through the system is exposed to wide temperature extremes (arctic to desert conditions).

3. the sizing of the liquid suppressant and pressurizing agent takes into account the compressibility of the liquid component.

THE DRAWINGS

Figure 2:
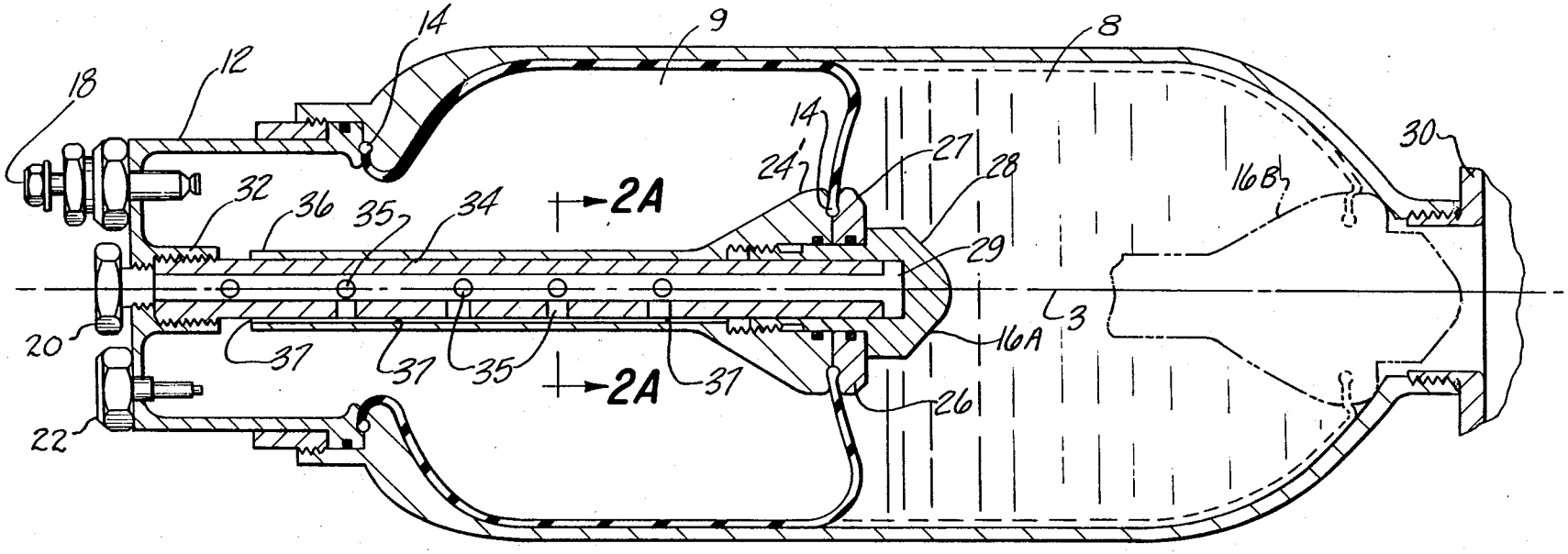
FIG. 2 is a longitudinal sectional view taken through a second embodiment of my invention.
Figure 2A:
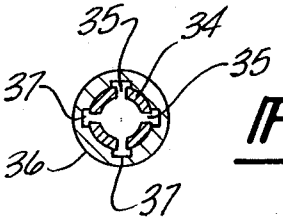

FIG. 2*a* is a fragmentary sectional view on line 2A—2A in FIG. 2.

Figure 3:
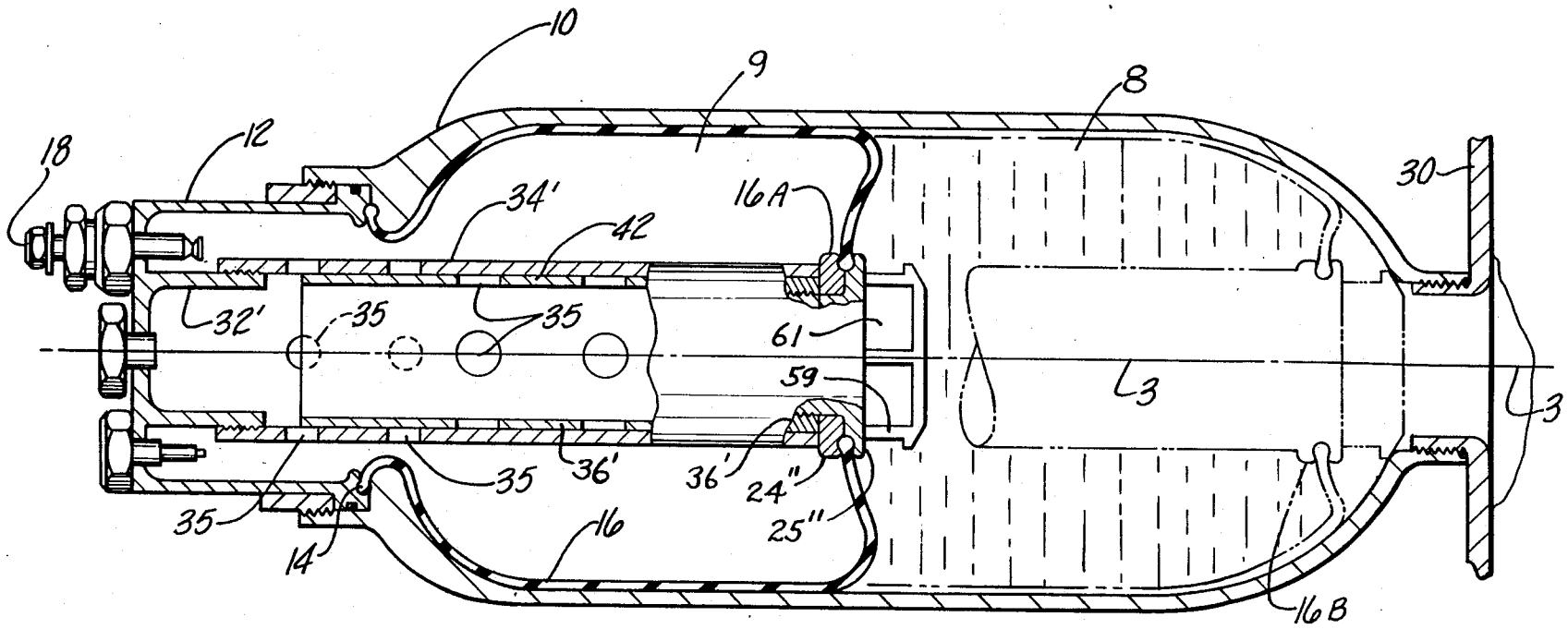

FIG. 3 is a sectional view taken through a third embodiment of my invention.

Figure 4:
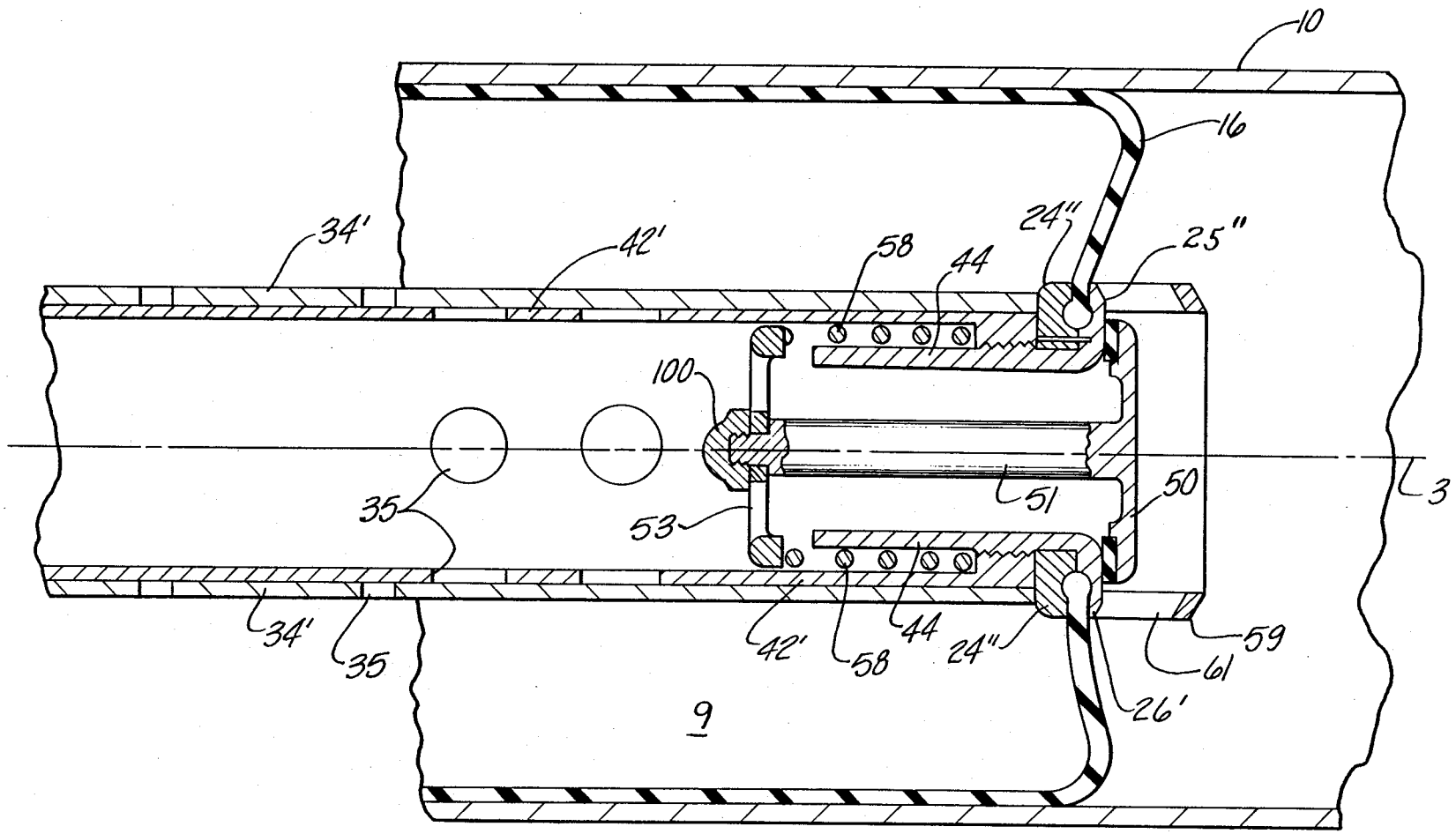

FIG. 4 is a fragmentary sectional view showing the valve assembly of FIG. 3 in its standby position (with the bottle fully charged).

Figure 5:
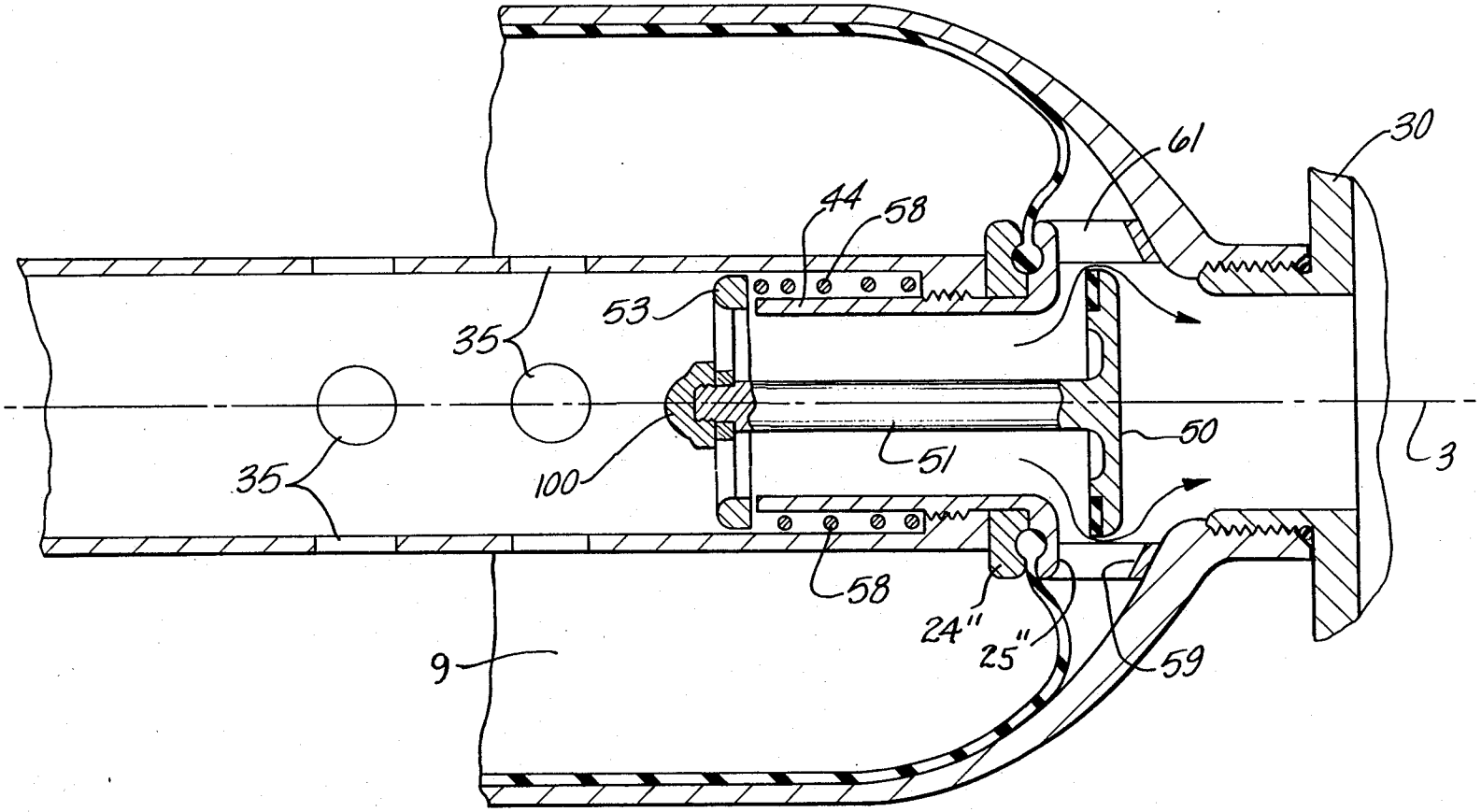

FIG. 5 is a fragmentary sectional view similar to FIG. 4 but showing the valve assembly at the instant when liquid fire suppressant is discharged from the bottle.

Figure 1:
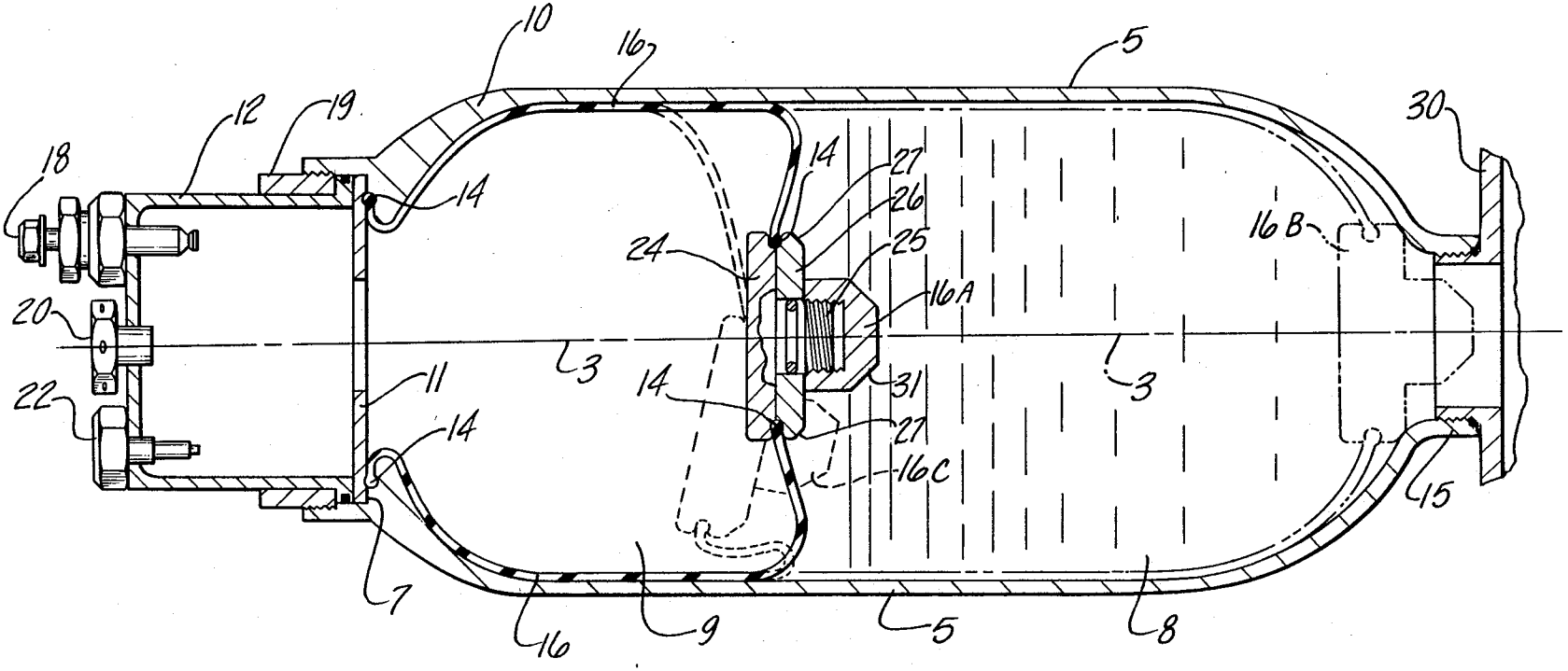
FIG. 1 is a longitudinal sectional view taken through one embodiment of my invention.
Figure 6:
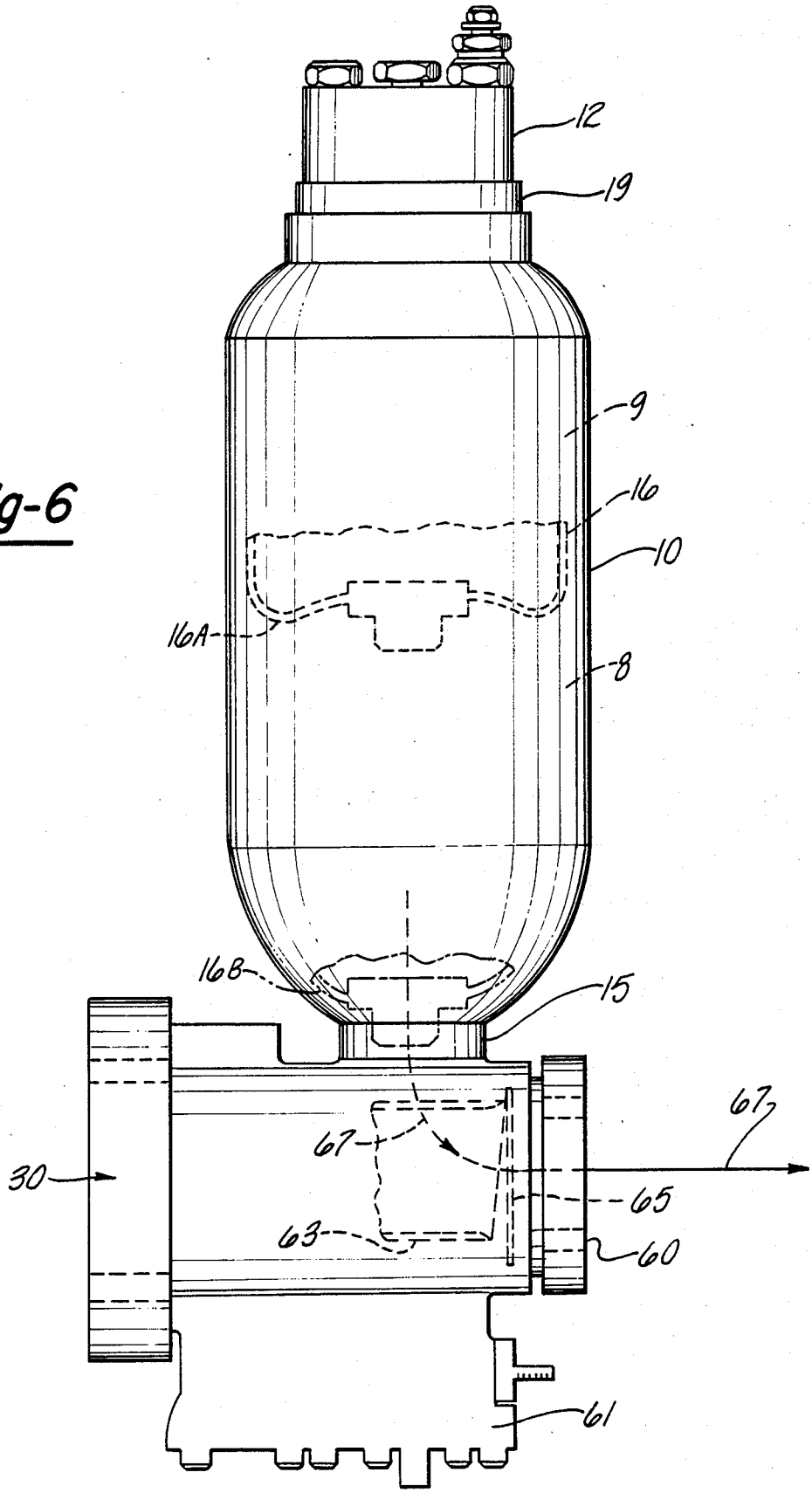

FIG. 6 is an elevational view of the FIG. 1 bottle mechanism and an associated control valve mechanism.

Figure 7:
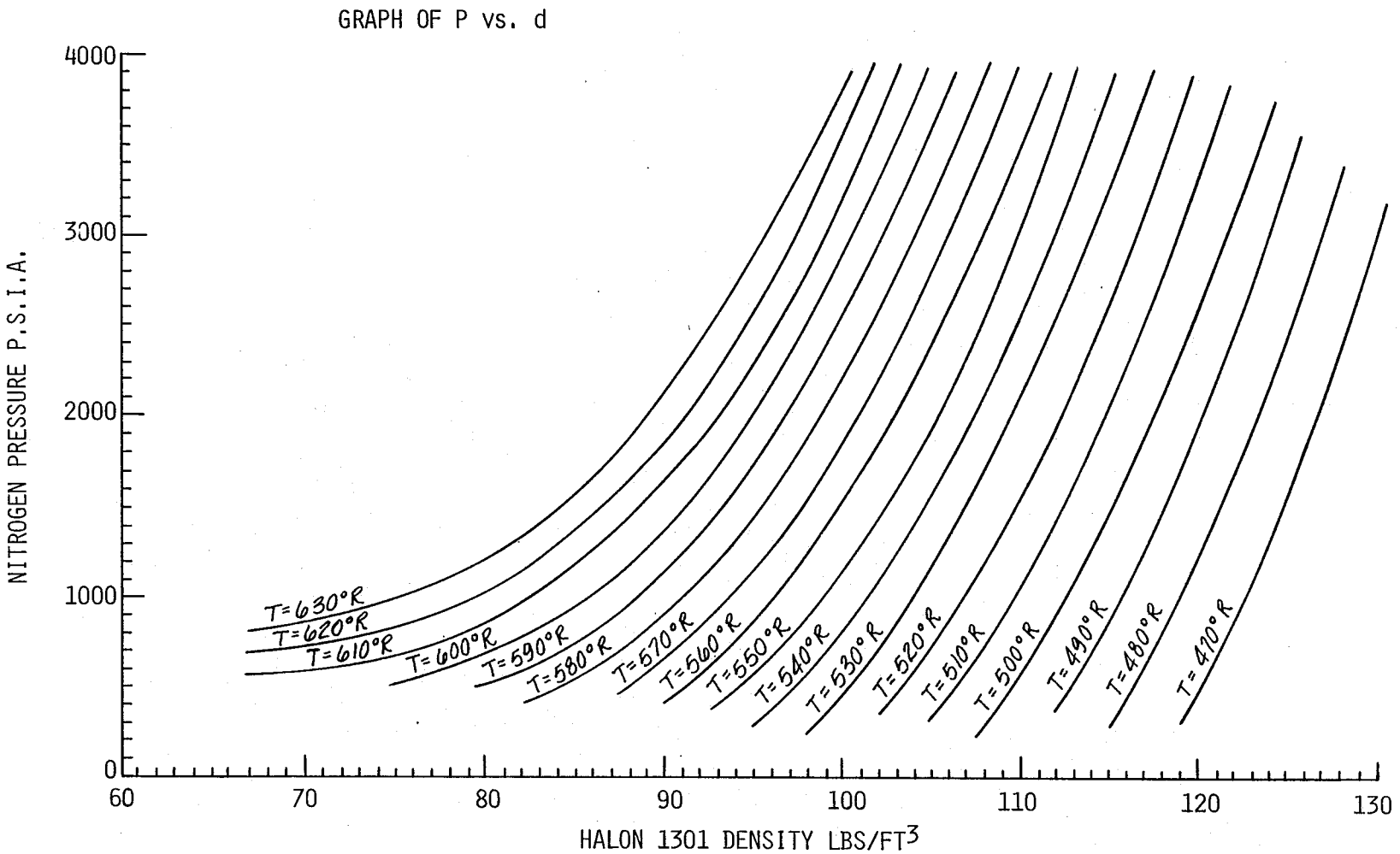
Figure 8:
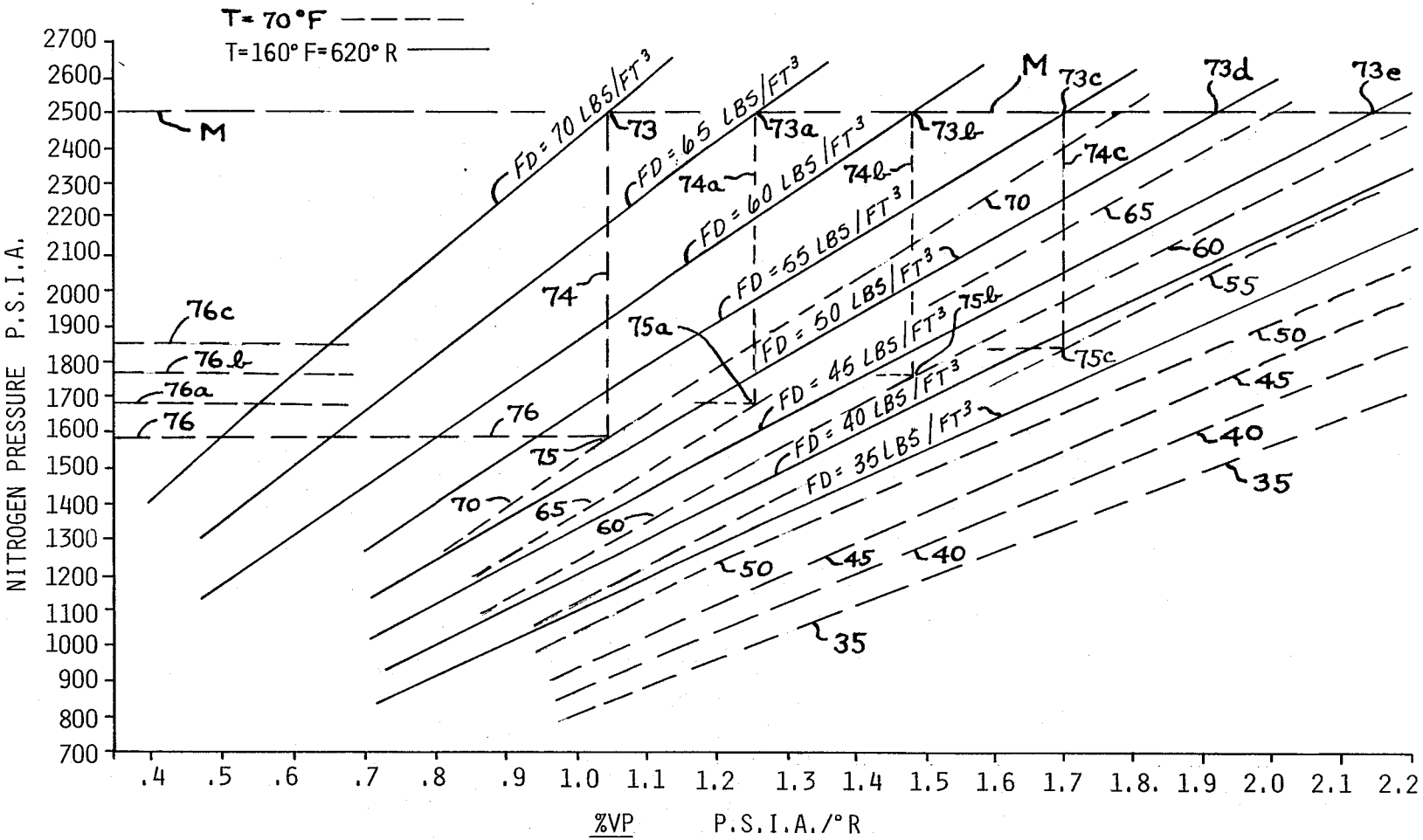

FIGS. 7 and 8 are graphs usable to size the systems shown in FIGS. 1 through 6.

An understanding of the various embodiments of the invention shown in FIG. 1 through 5 will be facilitated by initial reference to semidiagrammatic FIG. 6. The system shown in FIG. 6 comprises a bottle 10 having a flexible elastic bladder 16 subdividing the bottle internal volume into two variable volume chambers 8 and 9. Liquid fire extinguishant, such as Halon 1301 extinguishant, is charged into chamber 8; a pressurizing gas, such as nitrogen, is charged into chamber 9. Neck area 15 of the bottle has a control valve 30 screwed or otherwise affixed thereto. Metallic diaphragm 65 within control valve 30 normally retains the pressurized liquid within chamber 8; bladder 16 is normally in its retracted (non-stretched) condition designated generally by numeral 16A.

When an explosive squib within valve control section 62 is ignited annular knife element 63 is driven rightwardly against the upstream face of diaphragm 65. The diaphragm is punctured around its peripheral edge, thereby enabling the pressurized liquid to flow from chamber 8 through valve 30, as designated by numeral 67. The motive force for driving the liquid out of bottle 10 is provided by the pressurized gas in chamber 9; action of the pressurized gas causes bladder 16 to move from position 16A to position 16B. Gas pressures in the neighborhood of 750 psi to 2500 psi are contemplated, with 1500 psi being the preferred pressure at 70° F.

A piping system to distribute the liquid fire extinguishant to areas remote from the bottle may be connected to exit opening 60 of control valve 30. Alternately the liquid fire extinguishant can issue from exit opening 60 as a jet stream directly onto a fireball in the stream path.

The FIG. 6 arrangement differs from conventional "single chamber" bottle systems heretofore used by the U.S. military in suppression of explosive fires. In such single-chamber bottle designs, of the type shown for example in my U.S. Pat. No. 3,915,237 issued Oct. 28, 1975, the gaseous pressurizing agent (nitrogen) is introduced into the same space as the liquid fire extinguishant; the intent is to let the gaseous pressurizing agent occupy an upper portion of the bottle space, with the liquid extinguishant occupying the lower portion of said space. However, some of the pressurizing agent is undesirably dissolved in the liquid. For example, it has been estimated that with temperatures near 70° F. as much as 62% of the nitrogen enters into solution with the liquid Halon 1301 extinguishant in the single chamber bottle designs. Use of a bladder to physically separate the gaseous pressurizing agent from the liquid Halon 1301 extinguishant avoids problems associated with the nitrogen solubility phenomena.

In single chamber bottle designs the vapor pressure of Halon 1301 extinguishant ($CF_3Br$) is reduced by the mole fraction of nitrogen in solution. Typically the Halon vapor pressure might be on the order of 161 p.s.i.g., with the nitrogen vapor pressure 589 p.s.i.g.. The amount of nitrogen entering into solution is directly dependent on the nitrogen partial pressure. Solubility effects can be visualized as being similar to the action of carbon dioxide in water (carbonated soda water). During liquid discharge from a conventional single-chamber bottle the dissolved nitrogen tends to come out of solution as dispersed bubbles in the flowing liquid. The bubbles can significantly reduce the effective flow rate of the liquid Halon 1301 extinguishant in an action resembling vapor lock. Use of a bladder within the bottle, as shown in FIG. 6, eliminates the undesired flow retarding action associated with the presence of dissolved nitrogen in the liquid Halon 1301 extinguishant.

The bladder is also advantageous in that it permits the use of higher internal pressures in the bottle. With conventional "single chamber" bottle designs the internal pressure is usually less than 800 p.s.i.; higher pressures would undesirably increase the quantity of nitrogen in solution, thereby reducing the effective driving forces. A high temperature situation can be visualized, e.g., above 130° F., where all of the nitrogen is dissolved; the bottle is then liquid full. In such a situation the nitrogen would have to come out of solution before achievement of effective driving forces. Using a two chamber bottle design (with separating bladder) the internal pressure can be relatively high, e.g., 2000 p.s.i., (under the same total bottle volume conditions) with corresponding increase in driving force on the liquid during the liquid discharge process.

The two chamber bottle design can also make the bottle more versatile, i.e., usable where the single chamber design could not be used. The two chamber design can be mounted in a desired attitude or orientation, e.g., horizontally or vertically or an any intermediate inclination. Thus, in the FIG. 6 design chamber 9 can be above or below chamber 8. In the conventional "single chamber" bottle design the gaseous pressurizing agent is required to be above the liquid fire-extinguishant; this requirement imposes some constraints on how the bottle is to be oriented in the vehicle or other area requiring fire protection. In some vehicles it would be difficult to find space for a single chamber bottle, whereas the two chamber bottle could be used without difficulty.

FIGURE 1 EMBODIMENT

In FIG. 1 there is shown a fire extinguishant mechanism comprising a standard thick-walled bottle or container 10 formed of steel, ductile iron or other material (which meets the Department of Transportation requirements) suited to withstand proof pressures up to about 3000 p.s.i.. The bottle may be mounted in any angular position, e.g., upright, horizontal, or inverted. A cup-shaped end cap 12 may be employed to increase the bottle internal volume and thereby allow more propellant gas to be used, if required, than a conventional bottle without the end cap. End cap 12 advantageously provides for easy assembly of bladder 16 into the bottle prior to charging operations. The elastomeric bladder (membrane) 16 of hat-shaped configuration is anchored to the bottle by means of an annular disk 11 clamped against bottle end face 7 by means of annular threaded ring 19. Disk 11 overlies a bead 14 on the bladder to securely anchor the bladder and seal the container against leakage. Additionally disk 11 serves as a stop to limit movement of bladder 16 in a right-to-left direction, but only during the initial Halon 1301 extinguishant charging operation.

A conventional fill valve 18 is carried on end cap 12 for admitting (charging) propellant gas into the bottle. Safety valve 20 (containing a non-illustrated rupture disk) is mounted on end cap 12; at some predetermined pressure, e.g., 2600 p.s.i., the safety valve opens to release propellant gas from the bottle to the ambient atmosphere. Under normal conditions valve 20 remains in a closed condition. Pressure gage 22 measures the propellant gas pressure (chamber 9) and liquid fire suppressant pressure (chamber 8). In the illustrated system the pressure in chambers 8 and 9 are the same when the bottle is in its charged condition.

The bottle may be initially charged with a predetermined mass of liquid fire extinguishant, such as Halon 1301 extinguishant, by means of an auxiliary filler valve on control valve 30. The control valve may be constructed generally as shown in my copending U.S. patent application Ser. No. 433,571, filed on Oct. 8, 1982 and now abandoned. The filler valve may be constructed as shown in U.S. Pat. No. 3,491,783 issued in the name of O. L. Linsalato on Jan. 27, 1970 (see valve 37). During the operation of charging liquid into chamber 8 bladder 16 undergoes a leftward motion (FIG. 1) toward disk 11. Disk 11 acts as a stop to prevent motion of the bladder into cap 12.

After the system has been charged with Halon 1301 extinguishant (or other liquid fire extinguishant) enough propellant gas (e.g., nitrogen) is supplied through fill valve 18 so that the pressure exerted on the Halon 1301 extinguishant is greater than that required to keep the Halon 1301 extinguishant in a liquid state at all expected temperatures (e.g., arctic and desert temperatures). Temperature-pressure relationships necessary to maintain Halon 1301 extinguishant in the liquid (or gaseous) state are set forth in a pamphlet by E. I. DuPont de Nemours & Company title "Handling and Transferring Dupont's Halon 1301 Fire Extinguishants", Pamphlet FE-2A dated May 1973 (see FIG. 2 on page 3 of the pamphlet).

Referring to attached FIG. 1, reference number 16c shows in dashed lines the position that the bladder might take if bottle 10 were to be mounted in a horizontal position; numeral 16A indicates in full lines the general position taken by the bladder when the bottle is oriented vertically (upright or inverted). Halon 1301 extinguishant, the preferred liquid for the fire-extinguishant, has a relatively high coefficient of compressibility (or low modulus of elasticity); therefore the bladder position is affected to a certain extent by ambient temperature and pressure changes. At high ambient temperatures the internal pressure within the bottle increases;

the volume of the liquid increases, while the gas volume decreases, such that bladder 16 shifts to the left (FIG. 1). At low ambient temperatures bladder 16 shifts to the right. FIG. 1 represents an intermediate condition. When control valve 30 is opened the pressurized nitrogen expands, propelling the bladder toward dashed line position 16B; the liquid is driven out of the bottle through control valve 30.

The central area of bladder 16 is reinforced by means of a plate structure that includes two plates 24 and 26 suitably grooved at their peripheral edges to exert clamp forces on bead 14 of the bladder. A threaded stem 25 extends from plate 24 through plate 26 into a retaining nut 31. Side areas of the bladder engaged with bottle side wall 5 are reinforced by the bottle surface; during motion of the bladder from position 16A (or 16C) to position 16B the side areas of the bladder undergo elastic deformation (stretching) parallel to bottle axis 3. However the stretching forces on the side areas of the bladder are substantially uniformly applied around and along the bladder surface so that each incremental area is subjected to only a moderate unit area force.

The central end area of the bladder on or near bottle axis 3 is reinforced by plate structure 24, 25. As the bladder reaches the end of its stroke plate structure 24, 25 abuts against the end surface of the bottle to prevent bladder 16 from extruding itself through the opening provided by neck area 15 of the bottle. Plate 26 preferably has a beveled face 27 mated to the angulation of the bottle end wall near neck 15, such that a relatively large contact area is presented to the bottle surface (in order to distribute the shock forces).

During the short time interval required to discharge liquid propellant from chamber 8 through control valve 30 bladder 16 is subjected to very high acceleration forces and deceleration forces. At the beginning of the bladder stroke the bladder naturally has zero velocity; at the end of the bladder stroke (position 16B) the bladder has a very high velocity. Assuming 100 milliseconds to effect complete discharge of liquid through control valve 30, the bladder can have a peak velocity approaching 40 ft/sec. Plate structure 24,25 reinforces the bladder and absorbs shock forces, thereby preserving the bladder against destruction.

After the bottle mechanism has been used in a fire suppression operation (e.g. to extinguish an explosive fire within a military vehicle) the bottle mechanism can be recharged with new liquid suppressant without adding a new charge of gaseous pressurizing agent. The new liquid is admitted to chamber 8, using a modification of the procedure that was originally used. Modification of the procedure is dictated by the fact that when the original pressurizing agent in chamber 9 is reused the liquid extinguishant must be introduced to chamber 8 at a sufficient pressure to overcome the pre-existing chamber 9 pressure.

FIGURE 2 EMBODIMENT

In this embodiment of the invention the central bead 14 of elastomeric bladder 16 is clamped between a plate 26 and an enlarged end 24' on an elongated tube 36. Tube 36 is slidable along bottle axis 3 on an inner guide tube 34 suitably affixed to end cap 12, as by a threaded connection 32. Tube 34 is a hollow tube having a number of ports or apertures 35 therealong, whereby the interior of tube 34 continually communicates with chamber 9; grooves 37 in slidable tube 36 form fluid connections between chamber 9 and the various ports 35.

Tube 34 constitutes a stationary guide for ensuring a straight line motion of bladder 16 from its full line retracted position to its dashed line extended position; the aim is to minimize the possibility of bladder failure. Ports 35 prevent undesired depressurization of the zone within tube 34, as might tend to slow the motion of tube 36 on tube 34. Operationally the FIG. 2 embodiment is the same as the FIG. 1 embodiment.

EMBODIMENT OF FIG. 3 THROUGH 5

FIG. 3 illustrates the general features of a third embodiment of the invention. FIGS. 4 and 5 are fragmentary sectional views showing an automatic flush valve employed in the FIG. 3 embodiment.

The FIG. 3 embodiment is designed for use primarily in fire extinguisher systems in which liquid fire extinguishant would be forced from container 10 through a piping system for distribution of the fire extinguishant to an area remote from the container. A flush valve in the container (bottle) is designed to automatically open at the end of the bladder discharge stroke (position 16B), after which the pressurized gas flows from chamber 9 through the now-open flush valve to flush the liquid fire extinguishant through control valve 30 and the piping system attached thereto. Pressurized gas flows from container 10 through control valve 30 and the associated piping, thereby maintaining a driving force on the liquid extinguishant still in the piping when bladder 16 reaches the end of its discharge stroke.

As shown in FIG. 3, a plate structure 24'', 25'' is clamped to bead area 14 of bladder 16. The plate structure is suitably affixed to a hollow tube 36' that is slidably arranged along bottle axis 3 within a stationary guide tube 34'. Ports 35 are provided in the tubes for continuously admitting pressurized gas from chamber 9 into the tube interior as bladder 16 moves in a left-to-right direction. The aim is to minimize the possibility of semi-vacuum conditions within the tube interior as might exert a retarding effect on tube 36' motion.

FIG. 4 shows the previously mentioned flush valve. Valve poppet 50 is carried on a step 51 that is affixed to a spider 53 by means of a nut 100. A compression coil spring 58 normally biases along axis 3 the valve poppet to its closed position (FIG. 4). During standby periods the pressure in chambers 8 and 9 are equalized, whereby the controlling force on poppet 50 is spring 58.

FIG. 5 shows the FIG. 4 valve at the end of the bladder power stroke. An annular rigid wall structure 59 carried by plate 25'' impacts against the bottle end surface to limit the bladder motion; a ring of openings 61 may be provided in wall structure 59 to accommodate fluid flow around the edge of poppet 50. At the time when structure 59 impacts against the bottle end surface the fluid pressure on the right face of poppet 50 is momentarily reduced because the liquid fire extinguishant is no longer subjected to the driving force provided by the pressurized gas in chamber 9. The unit pressure on the left face of poppet 50 tends to be greater than the unit pressure on the right face of the poppet; the pressure imbalance tends to move poppet 50 to its FIG. 5 open position.

Poppet 50 may also tend to be opened because of inertia effects. Thus, although structure 59 impacts the bottle end surface to limit rightward motion of plate structures 24'' and 25'', poppet 50 motion is not directly affected by the impact action (except for the resilient connection provided by spring 58). Therefore inertia forces generated by bladder movement tend to keep poppet 50 and the attached parts moving rightwardly even after structure 59 impacts the bottle end surface. Irrespective of the exact mechanism, valve 50 assumes an open condition when the bladder reaches the end of its stroke. Gaseous pressurizing agent flows from chamber 9 into tube 36' and around poppet 50 as shown by the arrows in FIG. 5. The pressurizing agent thus maintains a driving force on the liquid fire extinguishant while the extinguishant is moving through the distribution piping (attached to the exit opening of valve 30). The action causes all (or substantially all) of the liquid to be applied to the fireball. It also maintains the Halon 1301 extinguishant in a pressurized condition, such that it has lessened tendency to flash vaporize before exiting from the piping system.

ADVANTAGES OF THE BLADDER IN TWO CHAMBER BOTTLE DESIGNS

The description of the FIG. 6 structure identified general advantages of two-chamber bottle (container) systems. Such two chamber systems are already known; see for example U.S. Pat. No. 4,194,572 to A. J. Monte, wherein a slidable piston is used as a barrier between a gaseous pressurizing agent and a liquid fire extinguishant. The use of a flexible, stretchable bladder is believed to be advantageous over a piston in that the bladder is not required to have moving (dynamic) seals.

During standby periods the barrier (bladder or piston) is required to move back and forth in accordance with temperature changes, i.e. resultant changes in the pressure of the pressurizing agent. When a piston is used as the movable barrier there is a potential transfer of fluid between the gas and liquid chambers (9 and 8 in the attached drawings). Even when the walls of the cylinder are of a mirror finish quality the dynamic seals do not completely wipe the walls clear of liquid during piston movement in a given direction; on return movement of the piston the liquid film on the cylinder wall can be transferred into the gaseous phase. In a somewhat similar fashion gas can migrate across the piston-cylinder interface to dilute the liquid. Water impurity in the nitrogen could then possibly react with the Halon 1301 extinguishant to form corrosive liquids.

The piston is also believed to have some disadvantages during the liquid discharge operation, i.e. a retarding action on piston motion. Over and beyond piston-cylinder friction, there are inertia effects associated with relatively heavy metal pistons (compared to relatively light elastomeric bladders), and piston cocking effects (if the piston length is small in relation to piston diameter).

SIZING THE BOTTLE CONTENTS

I use the term "sizing" to mean the process of determining the optimum gas pressure, optimum quantity (mass) of liquid Halon 1301 extinguishant, and optimum bottle size (volume), to be employed in order to satisfy a given fire suppression requirement, under a range of different operating temperatures (arctic to desert). Unless the three variables are properly "sized" the total liquid flow and/or liquid discharge rate (i.e. time to empty the bottle) will be less than optimum. For example, in the FIG. 1 system, if a relatively small mass of liquid Halon 1301 extinguishant is charged into chamber 8 (at 70° F.) bladder 16 will have a standby position to the right of that shown in FIG. 1; enlarged chamber 9 will contain a large volume of pressurizing agent. When valve 30 is opened the liquid halon is expelled at a rapid rate. However because only a small mass of Halon 1301 extinguishant was initially charged into the bottle there may be insufficient total liquid flow to extinguish the fire.

If a relatively large mass of liquid Halon 1301 extinguishant is initially charged into the bottle (at 70° F.) bladder 16 will have a standby position to the left of that shown in FIG. 1. When valve 30 is opened the pressurizing agent in chamber 9 experiences a significant volume change in order to fully expel the liquid out of the bottle. Such a large volume change is accompanied by a severe pressure reduction. The liquid flow rate during the latter stages of the liquid discharge process may be undesirably low, resulting in an insufficient average flow rate and perhaps in flashing of the Halon 1301 extinguishant, with associated retardation of liquid flow rate.

It might be thought that good results could be obtained merely by raising the charging pressure of the pressurizing agent to a very high value, e.g. 4000 p.s.i. However safety factors and strength of materials considerations tend to set an upper limit on the gas pressure. Federal regulations on safe transportation of charged bottles also set practical upper limits on bottle pressures. Under current conditions the practical upper limit is about 2500 p.s.i. It is contemplated that safety valve 20 (FIG. 1) will be set to open at 2650 p.s.i. for a design maximum operation pressure of 2500 p.s.i.

A principal use of the bottle system is in military vehicles subject to ambient temperature extremes, ranging from a low temperature of about −65° F. in the arctic to a high temperature of approximately 160° F. in the desert. It is believed impractical to vary the bottle charge when going from one temperature extreme to the other. Therefore a given bottle system must be sized (charged) to provide a suitable fire-extinguishant flow over a wide temperature range, e.g. between −65° F. and +160° F.

High ambient temperatures tend to raise internal pressure (and liquid extinguishant volume) within the bottle, whereas low temperatures tend to lower the bottle pressure (and liquid volume). If the ambient temperature should be such as to raise the internal pressure above the setting of safety valve 20 (e.g. 2650 p.s.i.) the valve will be actuated to prematurely release some or all of the gaseous pressurizing agent, thus reducing the bottle's fire-suppression capability. If the ambient temperature should be such as to lower the internal pressure below a satisfactory value the pressuring agent will exert insufficient driving force on the liquid fire extinguishant during the liquid discharge process. The effect of ambient temperature change should be taken into account when sizing the bottle system.

Another factor to be considered is compressibility of Halon 1301 extinguishant, the presently preferred liquid fire extinguishant, when initially charging the system. Halon 1301 extinguishant has at least ten times the compressibility of water and similar liquids. The bulk modulus of elasticity of water at 70° F. is approximately 250,000 p.s.i. to achieve a unit volume change. In contrast, the bulk modulus of elasticity of Halon 1301 extinguishant at the same temperature is less than 20,000 p.s.i. per unit volume change. Compressibility characteristics can affect the pressures and volumes of the liquid extinguishant and gaseous pressurizing agent achieved when the system is initially charged. As inferred in FIG. 7, high charging pressures (at any given charging temperature) tend to densify a given mass of Halon 1301 extinguishant into a small initial displaced volume.

A smaller initial displaced volume of liquid Halon 1301 extinguishant means a greater initial volume of gaseous pressurizing agent, hence a greater average driving force on the liquid Halon 1301 extinguishant during the liquid discharge process (because the pressurizing agent then experiences a proportionally smaller volume change during the discharge process). In general, if compressibility (elasticity) characteristics of the liquid are taken into account in the "sizing" process it is possible to increase the mass of Halon 1301 extinguishant charged into any given size bottle (compared to the mass of Halon 1301 extinguishant calculated without taking into account the compressibility factor).

Sizing of the system should be such that a satisfactory driving force is maintained on the liquid fire extinguishant during the entire course of the liquid discharge process. If the pressure of the gaseous pressurizing agent is at any time allowed to drop below a value where the driving force is less than the vapor pressure of the liquid Halon 1301 extinguishant there may be Halon 1301 extinguishant vaporization (boiling) and significant slowdown of the Halon 1301 extinguishant flow. The halon vapor pressure is temperature-dependent, being about 214 p.s.i.a. at 70° F. and 575 p.s.i.a. at 153° F. Whatever the ambient temperature condition, it is recommended that in so-called piped systems (FIG. 3) the system be sized so that the final end pressure of the gaseous pressurizing agent (i.e. at the end of the liquid discharge process) is at least about 200 p.s.i. or more above the Halon 1301 extinguishant vapor pressure at the existing temperature condition; in such piped systems the pressurizing agent is used not only to expel the extinguishant from the bottle, but also to flush liquid fire extinguishant through the piping system. In direct discharge systems (FIGS. 1 and 2) the final end pressure may only have to be about 40 p.s.i. above the Halon 1301 extinguishant vapor pressure.

The lower limit on the final end pressure of the gaseous pressurizing agent tends to set a lower limit on the initial pressure in accordance with the general formula:

$$\frac{P_1 V_1}{T_1} = \frac{P_2 V_2}{T_2}$$

where P represents pressure, V represents volume, T represents temperature of the pressurizing agent, and the subscripts 1 and 2 represent starting and ending conditions. It turns out that the initial pressure of the bottle system (at 70° F. room temperature charging conditions) should in practically every case be at least 1400 p.s.i.a. in order to provide maximum assurance of a satisfactory driving force during the latter stages of the liquid discharge process; actual pressures will be apparent from a study of FIG. 8. Of course, the bottle pressure may vary after initial charging (in accordance with ambient temperature variations), but if the charging pressure (at 70° F.) is above 1400 p.s.i.a. there will be sufficient driving force whatever the temperature condition at time of liquid discharge. The system will operate when the charging pressure is less than 1400 p.s.i.a., but with a longer discharge time.

By way of a summarization the principal factors to be considered are:

1. maintain sufficient driving force on the liquid fire-extinguishant during the entire discharge process; avoid bubble formation and vaporization in the liquid during the discharge process.
2. avoid liquid undercharging (insufficient liquid for effective fire suppression).
3. stay within pressures that can be safely handled by the bottle.
4. take into account wide ambient temperature extremes (−65° F. to +160° F.) that can significantly lower or raise the bottle pressure.
5. take into account the bulk modulus of elasticity or coefficient of compressibility of the liquid being used as the fire extinguishant (e.g. Halon 1301 extinguishant).

As previously noted, sizing the system involves estimation or calculation of three variables:

1. optimum mass of liquid fire extinguishant, e.g. Halon 1301 extinguishant
2. optimum total bottle volume
3. optimum gas charging pressure (at some specified temperature, e.g. 70° F.)

The optimum mass of fire extinguishant is determined by the expected nature of the fire to be suppressed. Normally the quantity would be expressed as pounds of extinguishant, e.g. 7 pounds, or 5 pounds, etc.

The total bottle volume is related to the available bottle sizes and available installation space(s) for the bottle system. In one case it might be feasible to use one large size bottle, e.g. a bottle of 204 cubic inch capacity for 7 pounds of extinguishant; in another case it might be more appropriate to use two smaller bottles, e.g. two bottles, each of 144 cubic inch capacity for containing 3.5 pounds of extinguishant in each bottle.

In order to determine the optimum gas charging pressure to be employed in a given bottle system I have devised the graph depicted in FIG. 8. The graph was derived in part by using Halon 1301 extinguishant density information depicted in FIG. 7.

FIG. 7 plots the Halon 1301 extinguishant density at different nitrogen pressures for a range of selected temperatures. It will be seen that for any selected temperature the Halon 1301 extinguishant density increases with increasing nitrogen pressure. FIG. 7 is graphical evidence of the compressible nature of Halon 1301 extinguishant.

FIG. 8 plots nitrogen pressure against the quantity % V P/T. As used in FIG. 8, % V is the volumetric percentage of the bottle occupied by the nitrogen. P is the absolute pressure of the nitrogen (and the Halon 1301 extinguishant), and T is the system temperature in ° R. The term P/T represents generally the effect of pressure and temperature on a given volume of nitrogen, e.g. pressure increase tends to lower the nitrogen volume, and temperature increase tends to raise the nitrogen volume. I have coined the term % V P/T as one way of comparing the effect of a given quantity of nitrogen on the liquid Halon 1301 extinguishant under different temperature conditions. The values of the coined term in FIG. 8 are not important in themselves.

FIG. 8 includes several full line curves with the designation "F.D=70", "F.D=60", etc. thereon. Other dashed line curves are merely labeled 70, 60, etc.; the F.D. is omitted for reading ease. In FIG. 8 the term F.D. (applicable to all curves) means fill density. Fill density (F.D.) represents the mass of liquid Halon 1301 extinguishant in a bottle having a volume of one cubic foot. The term fill density differs from the "density" term used in FIG. 7 in that the "volume" portion of the term is the entire bottle volume occupied by the liquid Halon 1301 extinguishant and the nitrogen pressurizing agent. The term fill density is a way to relate an absolute mass of Halon 1301 extinguishant to the appropriate bottle volume (even though the Halon 1301 extinguishant does not occupy all of the bottle volume).

In FIG. 8, each of the full line curves and dashed line curves plots a particular Halon 1301 extinguishant fill density against the system pressure. The full line curves represent conditions at 620° R. (160° F.); the dashed line curves represent conditions at 530° R. (70° F.). The dashed line curves can be used to obtain desired system pressure when the system is being charged (i.e. at room temperature). The full line curves can be used to determine the effect that high (desert) temperatures conditions have on system pressure.

The FIG. 8 curves were plotted using the FIG. 7 Halon 1301 extinguishant density values in conjunction with data from the previously-mentioned DuPont pamphlet FE-2A, and the following equation:

$$P = 89.2367d - 6.56839d^2 + 8.96196 \times 10^{-2} d^3 - 5.15817 \times 10^{-4} d^4 + T\,[-2.00627 \times 10^{-1} d + 1.54274 \times 10^{-2} d^2 - 2.39334 \times 10^{-4} d^3 + 1.41329 \times 10^{-6} d^4]$$

where P is the pressure required to maintain the Halon 1301 extinguishant in a liquid condition under a given ambient temperature T, and d is the density of the liquid Halon 1301 extinguishant at the given temperature T.

In sizing a system the starting point is the calculation of liquid fire-extinguishant required to suppress an expected fire. The necessary bottle volume(s) is/are selected on the basis of the required mass of liquid fire-extinguishant. Suppose for example that the estimated mass of liquid extinguishant for suppressing an expected fire is 7 pounds. If it is desired to use only one standard size bottle of 0.11 $ft^3$ total volume we could use the two "F.D=70" curves in FIG. 8 to calculate the required nitrogen charging pressure.

A fill density of 70 multiplied by the bottle volume of 0.11 gives a Halon 1301 extinguishant mass of 7.7 pounds, sufficient to meet the seven pound requirement. It would also be possible to meet our requirement with a fill density of 65 (65 multiplied by 0.11 gives a halon mass of 7.15 pounds).

If it was desired to use two standard size bottles, each of 0.083 $ft^3$, we might then select a different fill density, e.g. 50 $lbs/ft^3$. Thus, $50 \times 0.083 = 4.15$ for each bottle (which meets the requirement of 3.5 pounds for each bottle). A fill density of 45 $lbs/ft^3$ would also meet the requirement.

The selected fill density is used in the FIG. 8 graph to calculate an optimum nitrogen charging pressure. In FIG. 8, the appropriate dashed line curve (e.g. F.D.=70) would be used to calculate the initial charging pressure, whereas the corresponding full line curve would be used to estimate the effect of high (desert) temperatures on the system.

It will be recalled that one of the selection criteria is to size the system so that internal pressures never exceed some safe value, e.g. 2500 p.s.i. In FIG. 8 line M represents the maximum safe system pressure; we assume this will occur at the highest operating temperature of 620° R. (160° F.). Point 73 represents one possible operating point for the "F.D.=70" system designed to stay within the 2500 p.s.i. high temperature ceiling. An imaginary vertical line 74 can be drawn downwardly from point 73 to intersection point 75 on the F.D.=70 line for the 70° F. (530° R.) condition. Horizontal line 76 drawn leftwardly from point 75 denotes the estimated charging pressure to be used for the "F.D.=70" system.

The desired high temperature points for systems operating at other liquid fill densities are denoted by numerals *73a*, *73b*, *73c*, etc. The corresponding room temperature pressure settings for such other systems are denoted by numerals *75a*, *75b*, *75c*, etc. In general, the lower the Halon 1301 extinguishant fill density the higher will be the optimum nitrogen charging pressure.

It will be understood that FIG. 8 represents the condition of each system under two different standby temperatures (70° F. and 160° F.). FIG. 8 is used only to establish the initial charging pressure (line 76, *76a*, *76b*, etc.) that can be used without creating excessively high system pressures under desert conditions. FIG. 8 does not indicate how the system pressure drops during the liquid discharge process, or what the system pressure is at the end of the liquid discharge process. However it is known that if starting points 73, *73a*, *73b*, etc. are as designated in FIG. 8, the pressure at the end of the liquid discharge process will be sufficiently high to avoid liquid vaporization or lack of driving force during the latter stages of the process. For the preferred fill densities of 45 pounds per cubic foot, or higher, the charging pressures, at 70° F., should be at least 1000 to 1400 p.s.i.a. with 1400 p.s.i.a. preferred in order to achieve satisfactory driving forces on the liquid during the liquid discharge process.

The curves of FIGS. 7 and 8 are specifically for Halon 1301 extinguishant systems. Systems using other liquid fire-extinguishants would require different curves. The illustrated curves are usable with systems wherein the barrier between the liquid extinguishant and gaseous pressurizing agent is a bladder (as shown in FIGS. 1 through 6) or a piston (as shown for example in U.S. Pat. No. 4,194,571).

The value of the sizing method herein described may be visualized by referring to U.S. Pat. No. 2,804,929 issued on Sept. 3, 1957 in the name of H. Plummer. The Plummer patent shows in FIG. 1 thereof a fire suppressant bottle system wherein liquid fire extinguishant is located to the right of a bladder 16; the zone to the left of bladder 16 is occupied by a gaseous pressurizing agent such as carbon dioxide. The patentee indicates at column 3, line 73, that pressures in the range from 100 p.s.i. to 600 p.s.i. are to be used.

It will be noted from FIG. 1 of the Plummer patent that area 20 occupied by the pressurizing agent is very small in relation to the "liquid" area to the right of bladder 16. In order for the pressurized gas to drive out all of the liquid through discharge valve 43 the gas must undergo a significant volume increase (about 1200% with the illustrated volumetric relationships). Such a large increase in gas volume is accompanied by a significant reduction in gas pressure. Even with a starting pressure of 600 p.s.i. the pressure during the latter stages of the liquid discharge process would be very low. The Plummer patented system is believed to suffer in the sense that it is a very slow-acting system suited only to use on slow-growth fires. In contrast, applicant's bottle structure and sizing method enable the system to be used on explosive fires where large quantities of liquid fire extinguishant are required to be applied to an emergent fireball within a very short period of time, e.g. seven pounds within approximately 95 milliseconds.

I wish it to be understood that I do not desire to be limited to the exact details of construction shown and described for obvious modifications will occur to a person skilled in the art, without departing from the spirit and scope of the appended claims.

I claim:

1. A fire suppressant mechanism comprising a container; a flexible bladder subdividing the container into two separate chambers; a liquid fire extinguishant occupying one of the chambers; a gaseous pressurizing agent occupying the other chamber to bias the bladder in the direction of the liquid fire extinguishant; a liquid discharge valve communicating with said one chamber, whereby when the valve opens the pressurizing agent acts on the bladder to discharge the liquid fire extinguishant through the open valve; and rigid force absorber means carried by a central area of the bladder to impact against one end of the container for limiting bladder motion without damaging the bladder material; wherein the bladder has a central annular bead therein; said rigid force absorber means comprising two rigid plates clamped together, said plates having annular confronting grooves mated to said annular bead for securely retaining the plates on the bladder.

2. The mechanism of claim 1 wherein the bladder is formed of non-permeable elastomeric material; the stroke of the bladder being such that the bladder is required to undergo a stretching action before the force absorber means reaches said one end of the container.

3. A fire suppresent mechanism comprising a container; a flexible bladder subdividing the container into two separate chambers; a liquid fire extinguishant occupying one of the chambers; a gaseous pressurizing agent occupying the other chamber to bias the bladder in the direction of the liquid fire extinguishant; a liquid discharge valve communicating with said one chamber, whereby when the valve opens the pressurizing agent acts on the bladder to discharge the liquid fire extinguishant through the open valve; and rigid force absorber means carried by the central area of the bladder to impact against one end of the container for limiting bladder motion without damaging the bladder material; and further comprising a guide structure located on the movement axis of the bladder for slidable engagement with the rigid force absorber means.

4. The mechanism of claim 3 wherein the guide structure is a first hollow tube having one of its ends anchored to the container, and a second hollow tube carried by the rigid force absorber means in slidable engagement with the first hollow tube.

5. The mechanism of claim 4 wherein the tubes having ports therealong for admitting pressurizing agent into the tube interior during motion of the bladder.

6. The mechanism of claim 1 and further comprising a flush valve means carried by the rigid force absorber means for automatic operation to an opened condition when said force absorber means impacts against said one end of the container.

7. The mechanism of claim 6 wherein the flush valve means includes a valve element having one face thereof exposed to the pressurizing agent and another face thereof exposed to the liquid fire extinguishant.

8. The mechanism of claim 7 wherein the valve element is opened at least partly by a pressure differential thereacross.

9. The mechanism of claim 1 wherein the pressure of the gaseous pressurizing agent is in a range from 750 p.s.i. to 2000 p.s.i.

10. The mechanism of claim 1 wherein the pressure of the gaseous pressurizing agent is at least 1400 p.s.i.

11. The mechanism of claim 1 wherein the liquid fire extinguishant has a vapor pressure sufficient to cause vaporization of the liquid under normal atmospheric pressure conditions; the gaseous pressurizing agent being at a sufficient pressure to prevent vaporization of the liquid during the liquid discharge process.

12. The mechanism of claim 1 wherein the bladder is of hat-like configuration.

13. The mechanism of claim 12 wherein the bladder is anchored to the container near the end of the container remote from the liquid discharge valve.

14. The mechanism of claim 1 and further comprising a normally closed flush valve means carried by the rigid force absorber means for automatic opening when the force absorber means impacts against said one end of the container; said force absorber means comprising an annular wall (59) projecting from the bladder to engage the end of the container; said flush valve means including a poppet valve element disposed within said annular wall, a stem extending from the poppet valve element, a spider carried by the stem, and compression spring means exerting a force on the spider tending to hold the poppet valve element in its closed position.

15. A fire suppressant mechanism comprising an elongate container; a flexible bladder subdividing the container into two separate chambers; a liquid fire extinguishant occupying one of the chambers; a gaseous pressurizing agent occupying the other chamber to bias the bladder in the direction of the liquid fire extinguishant; the bladder having an interface portion facing generally axially toward the one chamber and extending substantially entirely across the cross section of the container; a liquid discharge valve communicating with said one chamber, whereby when the valve opens the pressurizing agent acts on the bladder to discharge the liquid fire extinguishant through the open valve; rigid force absorber means carried by a central area of the bladder to impact against one end of the container for limiting bladder motion without damaging the bladder material; and a flush valve carried by the rigid force absorber means, the flush valve automatically opening when the force absorber means impacts against the one end of the container.

16. The mechanism of claim 15 wherein said flush valve means includes a poppet valve element disposed within said annular wall, a stem extending from the poppet valve element, a spider carried by the stem, and compression spring means exerting a force on the spider tending to hold the poppet valve element in its closed position.

17. The mechanism of claim 15 wherein the bladder is expandable substantially only toward the one chamber.

* * * * *